US008763299B2

(12) United States Patent
Clifton et al.

(10) Patent No.: US 8,763,299 B2
(45) Date of Patent: Jul. 1, 2014

(54) VERTICALLY ADJUSTABLE SCOPE BASE

(75) Inventors: Buddy G. Clifton, Pearblossom, CA (US); Linda Clifton, Pearblossom, CA (US)

(73) Assignee: Arc-Angle Solutions, Inc., Atascadero, CA (US)

( * ) Notice: Subject to any disclaimer, the term of this patent is extended or adjusted under 35 U.S.C. 154(b) by 39 days.

(21) Appl. No.: 13/543,113

(22) Filed: Jul. 6, 2012

(65) Prior Publication Data

US 2013/0008073 A1 Jan. 10, 2013

Related U.S. Application Data

(60) Provisional application No. 61/505,222, filed on Jul. 7, 2011.

(51) Int. Cl.
*F41G 1/387* (2006.01)

(52) U.S. Cl.
CPC ..... *F41G 1/387* (2013.01)
USPC ..... 42/125

(58) Field of Classification Search
USPC ..... 42/124–127, 136, 138; 248/178.1, 248/187.1
See application file for complete search history.

(56) References Cited

U.S. PATENT DOCUMENTS

| | | | | |
|---|---|---|---|---|
| 4,742,636 | A * | 5/1988 | Swan | 42/126 |
| 5,180,875 | A * | 1/1993 | Berry et al. | 42/122 |
| 5,274,941 | A * | 1/1994 | Moore | 42/126 |
| 7,647,720 | B1 * | 1/2010 | Vendetti | 42/126 |
| 7,827,724 | B1 * | 11/2010 | Spinelli | 42/124 |
| 8,240,075 | B1 * | 8/2012 | Mullin | 42/125 |
| 2012/0085014 | A1 * | 4/2012 | Riley et al. | 42/115 |

* cited by examiner

*Primary Examiner* — Reginald Tillman, Jr.

(57) ABSTRACT

A vertically adjustable scope base designed to mitigate parallax induced aiming errors. The apparatus comprises a rail assembly, a front base, a rear base, a pivot fastener, an incline mechanism, and an incline adjuster. The rail assembly comprises an optics mount, a pivot mount, an inline mechanism mount. The front base comprises a pivot mechanism. The rear base comprises a threaded sleeve. The front base and the rear base each comprise an attachment mechanism to mount the apparatus to a weapon system. The Incline mechanism comprises a housing, a first and second bevel gear, and a threaded extension rod. The incline adjuster comprises an axle assembly, a dial, and a base. The configuration of these components and sub-components allow a user to quickly and precisely adjust an optical sight's angle of incline instead of repositioning the reticle to align the crosshairs with an intended point of impact.

19 Claims, 5 Drawing Sheets

VERTICALLY ADJUSTABLE SCOPE BASE

The current application claims a priority to the U.S. Provisional Patent application Ser. No. 61/505,222 filed on Jul. 7, 2011.

FIELD OF THE INVENTION

The present invention relates generally to a firearms accessory. More specifically to a firearms accessory that serves as a vertically adjustable scope base that mitigates optical sight parallax and parallax induced aiming error. The present invention accomplishes this through the use of an optical mount that utilizes an adjustable incline mechanism to compensate for reticle misalignment by precisely repositioning the optical sight instead of readjusting the weapons reticle.

BACKGROUND OF THE INVENTION

Projectile weapons, specifically small arms have long relied on optical sights to increase the weapons accuracy at range. Telescopic and electronic gun sights provide a user with a magnified field of view that when oriented towards a target's direction facilitates the user's target acquisition and produces more accurate shot placement. To achieve these results, optical sights have to properly calibrate the positioning of the reticle. The reticle is the set of intersecting lines that serve as the crosshairs and positioned within the optical sight in a manner that is viewable to the user when they position their eye on the ocular. Proper positioning of the reticle aligns the sight's crosshairs with the intended point of impact for the projectile. A user would increase or decrease the vertical positioning of the reticle to accurately adjust the crosshairs to coincide with the point of impact for the projectile. At increased distances, a user has to significantly decrease the vertical positioning of the reticle to align the crosshairs with the point of impact due to bullet drop. Although, many optical sights are able to adjust the positioning of their reticle with a distant target, the increased distances create another issue that can result in aiming errors.

Optical sights rely on a moveable reticle that is positioned in front of the ocular, but placed behind the objective lens. When the user peers through an optical sight the reticle images appears superimposed over the magnified image. Due to the reticle and the magnified image not being coplanar to one another, the positioning of the reticle relative to the magnified image, as perceived by the user's eye may be misaligned. This issue is an optical effect known as parallax. Parallax is the displacement or difference of the apparent position of an object viewed along two different lines of sight. Shot placement misalignment caused by parallax, or parallax induced aiming errors as it is commonly known, is well documented and optical sights have developed mechanisms that allow a user to adjust and compensate for the miss alignment of a reticle with a magnified image.

Some of the mechanisms that are currently available to compensate for parallax consist of an integrated parallax compensation mechanism found within the optical sight and specially designed optical sights that eliminate parallax aiming errors within a specified range. The integrated parallax compensation mechanisms are able to effectively compensate for the parallax induced errors by incorporating a moveable optical element that enables the optical system to project the image of the object at varying distances and have the reticle's crosshairs projected on the same optical plane. Another method that is currently available on the market is the use of a permanently calibrated optical sight. These optical sights perform effectively without the compensation for parallax induced error by being permanently calibrated for the distance that best suits their intended use. While both of these solutions are able to reduce parallax induced aiming errors, they suffer from several disadvantages.

One drawback that is seen in adjustable optical sights is that they can only effectively compensate for parallax without adjustment while the intended target is found within a specific distance. While this inconvenience is nearly unavoidable at greater distances, it does require frequent repositioning of the reticle to compensate for parallax. The frequent readjustment of a reticle can result in wear and tear to the intricate mechanisms that are found within the optical sight. These mechanisms are difficult to replace and service if damaged, and most often, a malfunctioning or damaged optical sight requires a complete replacement. Still another disadvantage that is associated with readjustment of the reticle is the inability to verify at what distance the reticle is calibrated for. This disadvantage can be time consuming and frustrating for users to verify and is a nuisance for users who need to quickly readjust the reticle for aiming at a plurality of targets with varying distances. While the permanently calibrated optical sights do not suffer from the wear and tear associated with the frequent readjustment of the reticle, these optical sights suffer from another disadvantage as a result of their design. The permanently calibrated optical sights are unable to effectively compensate for parallax outside their intended range. This obvious limitation can create several situations where the sight is unable to effectively function. While both of these types of optical sights have disadvantages related to their parallax compensation function, they also carry and economic disadvantage. Both of these optical sights are significantly more expensive relative to the price of optical sights that do not include these parallax compensation mechanisms.

Therefore, it is the object of the present invention to resolve the parallax induced error that occurs in optical sights through an apparatus that adjusts the elevational positioning of an optical sight as opposed to requiring the optical device to constantly readjust the positioning of the reticle. This apparatus allows a user to quickly calibrate their optical sights for acquiring targets at varying distances.

DETAIL DESCRIPTIONS OF THE INVENTION

All illustrations of the drawings are for the purpose of describing selected versions of the present invention and are not intended to limit the scope of the present invention.

Figure 1:
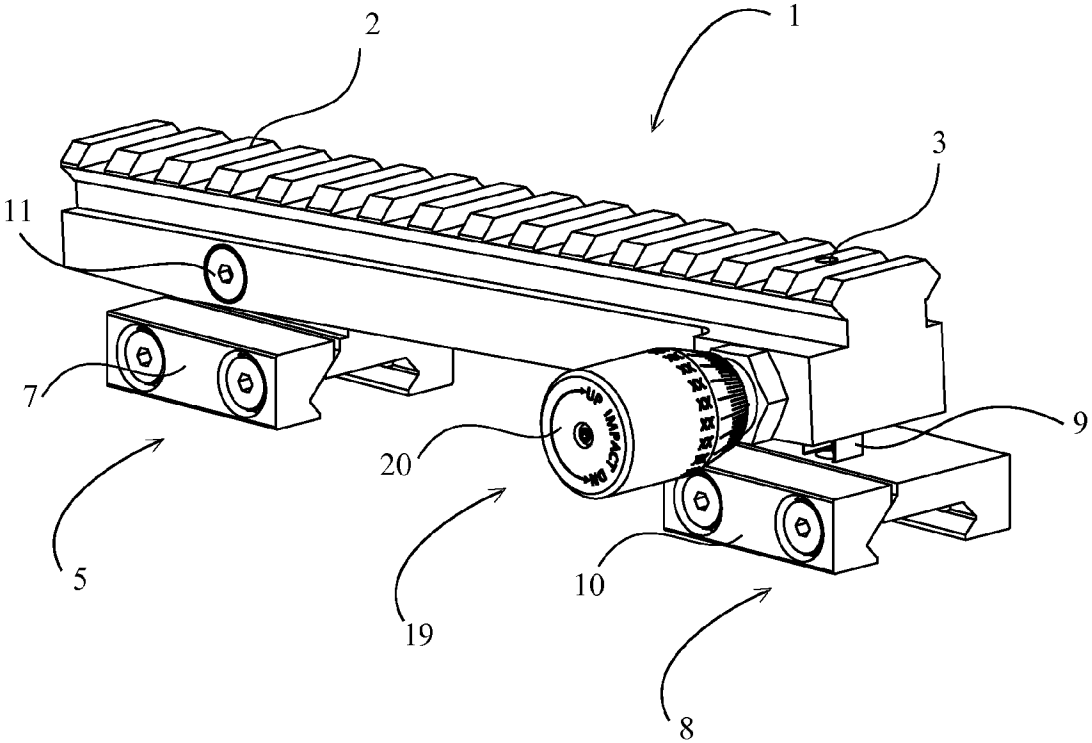
FIG. 1 is a perspective view of the vertically adjustable scope base in a partially elevated position as per the current embodiment of the present invention.

Referencing FIG. 1, the present invention relates to a vertically adjustable scope base that provides users with an alternative for adjusting optical sights in order to compensate for parallax induced aiming errors that occur at increased distances. The vertically adjustable scope base comprises a rail assembly 1, a front base 5, a rear base 8, an incline mechanism 12, an incline adjuster 19, and a pivot fastener 11. The incline adjuster 19 and the incline mechanism 12 allows the rail assembly 1 to increase its angle of inclination which provides an attached optical sight with the ability to compensate for parallax without requiring adjustment to the reticle's positioning. The rail assembly 1 allows for the attachment of a plurality of optical sights that best suits a user's preference. The front base 5 and the rear base 8 provide the present invention the ability to be attached to a plurality of small arms.

Figure 2:
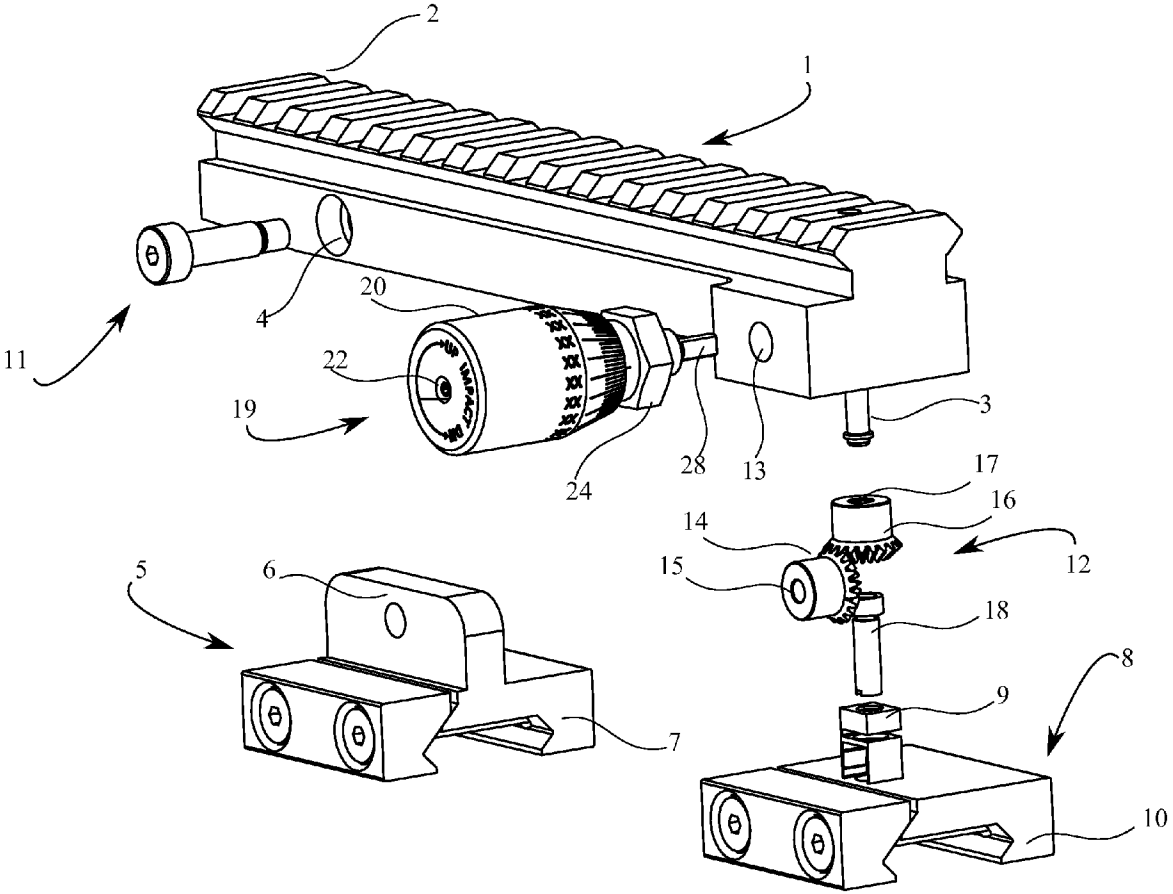
FIG. 2 is an exploded view of the main components of the vertically adjustable scope base as per the current embodiment of the present invention.

Referencing FIG. 2, the rail assembly 1 is the primary attachment point for a plurality of optical sights that can be utilized by the present invention. The rail assembly 1 is positioned parallel to the front base 5 and the rear base 8. The rail assembly 1 comprises an optics mount 2, an incline mechanism mount 3, and a pivot mechanism 4. The optics mount 2 is positioned along the exterior of the rail assembly 1. The incline mechanism mount 3 is positioned on the rail assembly 1, but opposite to the optics mount 2. The pivot mechanism mount 4 is positioned on the exterior of the rail assembly 1, and opposite to the optics mount 2. The incline mechanism mount 3 is positioned opposite the pivot mechanism mount 4 along the rail assembly.

Referencing FIG. 2, the rail assembly 1 is positioned parallel to the front base 5 and the rear base 8. The front base 5 and the rear base 8 are positioned coplanar to each other. The front base 5 and the rear base 8 functions as the attachment component between the present invention and a user's desired weapon system. Additionally, the front base 5 serves as the pivot point for the present invention. The front base 5 comprises a pivot mechanism 6 and a front base attachment mechanism 7. The front base attachment mechanism 7 is positioned opposite to the pivot mechanism 6. The rear base 8 comprises a threaded sleeve 9 and a rear base attachment mechanism 10. The threaded sleeve is positioned opposite to the rear base attachment mechanism 10.

Referencing FIG. 2, the incline mechanism 12 serves as the vertical movement component for the present invention. The incline mechanism 12 raises and lowers the rail assembly's 1 angle of incline. The incline mechanism 12 is positioned collinear with the rear base 8. The incline mechanism 12 is found adjacent to the rail assembly 1. The incline mechanism 12 comprises an incline mechanism housing 13, an adjuster bevel gear 14, an extension rod bevel gear 16, and a threaded extension rod 18. The adjuster bevel gear 14, the extension rod bevel gear 16, and the threaded extension rod 18 are found positioned within the incline mechanism housing 13. The adjuster bevel gear 14 is perpendicularly engaged to the extension rod bevel gear 16. The axle mount 15 is concentrically positioned to the adjuster bevel gear 14. The adjuster bevel gear 14 comprises an axle mount 15. The extension rod bevel gear 16 comprises an extension rod mount 17. The extension rod mount 17 is positioned concentrically to the extension rod bevel gear 16. The threaded extension rod 18 is rotatably connected to the extension rod bevel gear 16 by way of the extension rod mount 17. The front base 5 and the rail assembly 1 are pivotally connected by the pivot fastener 11. The aforementioned attachment, establishes a pivot point for the present invention. The pivot mechanism 6 is positioned within the pivot mechanism mount 4. The pivot mechanism 6 is pivotally connected to the pivot mechanism mount 4 by the pivot fastener 11. The incline mechanism 12 and the rail assembly 1 are affixed by way of the incline mechanism mount 3. The threaded extension rod 18 is positioned collinear to the threaded sleeve. The threaded extension rod 18 is engaged with the threaded sleeve 3.

Figure 3:
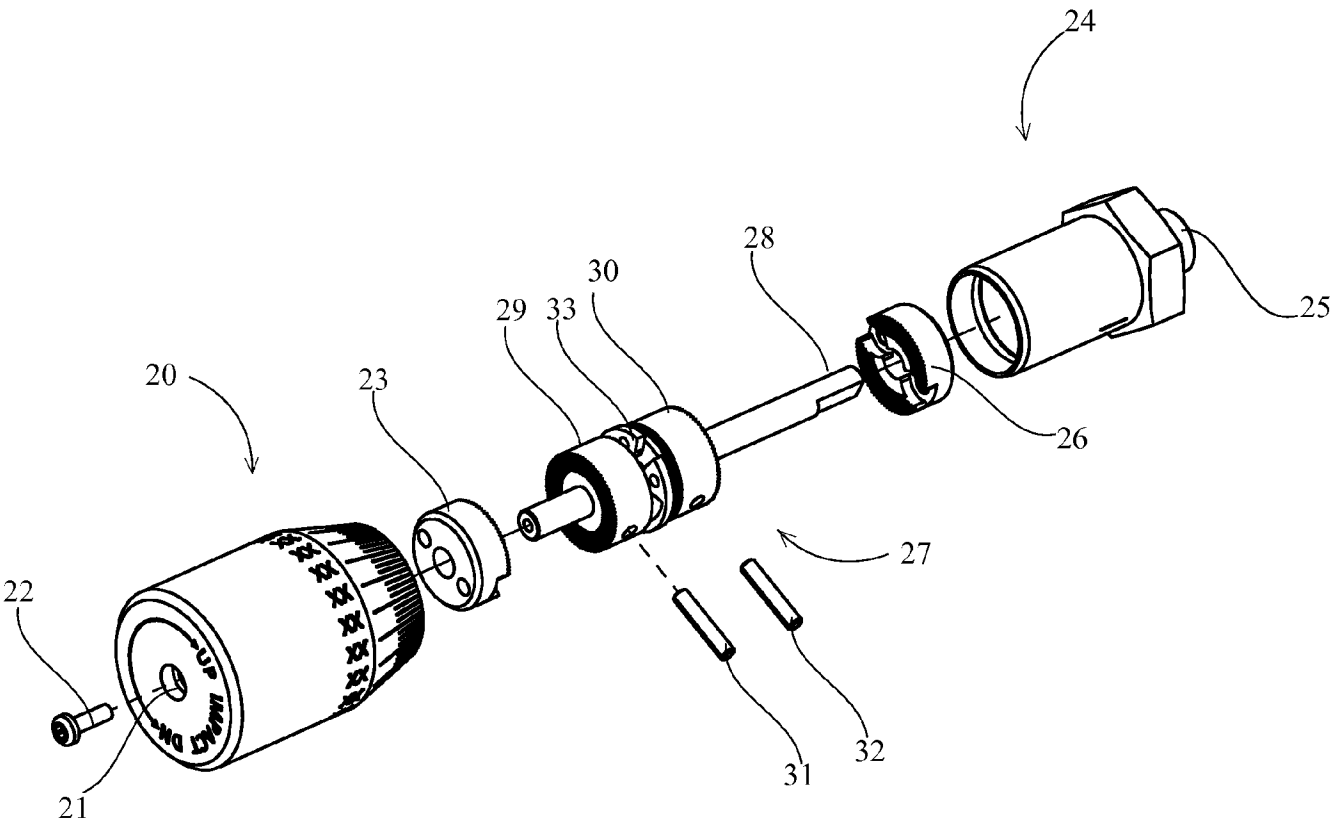
FIG. 3 is an exploded view of the incline adjuster of the vertically adjustable scope base as per the current embodiment of the present invention.
Figure 4:
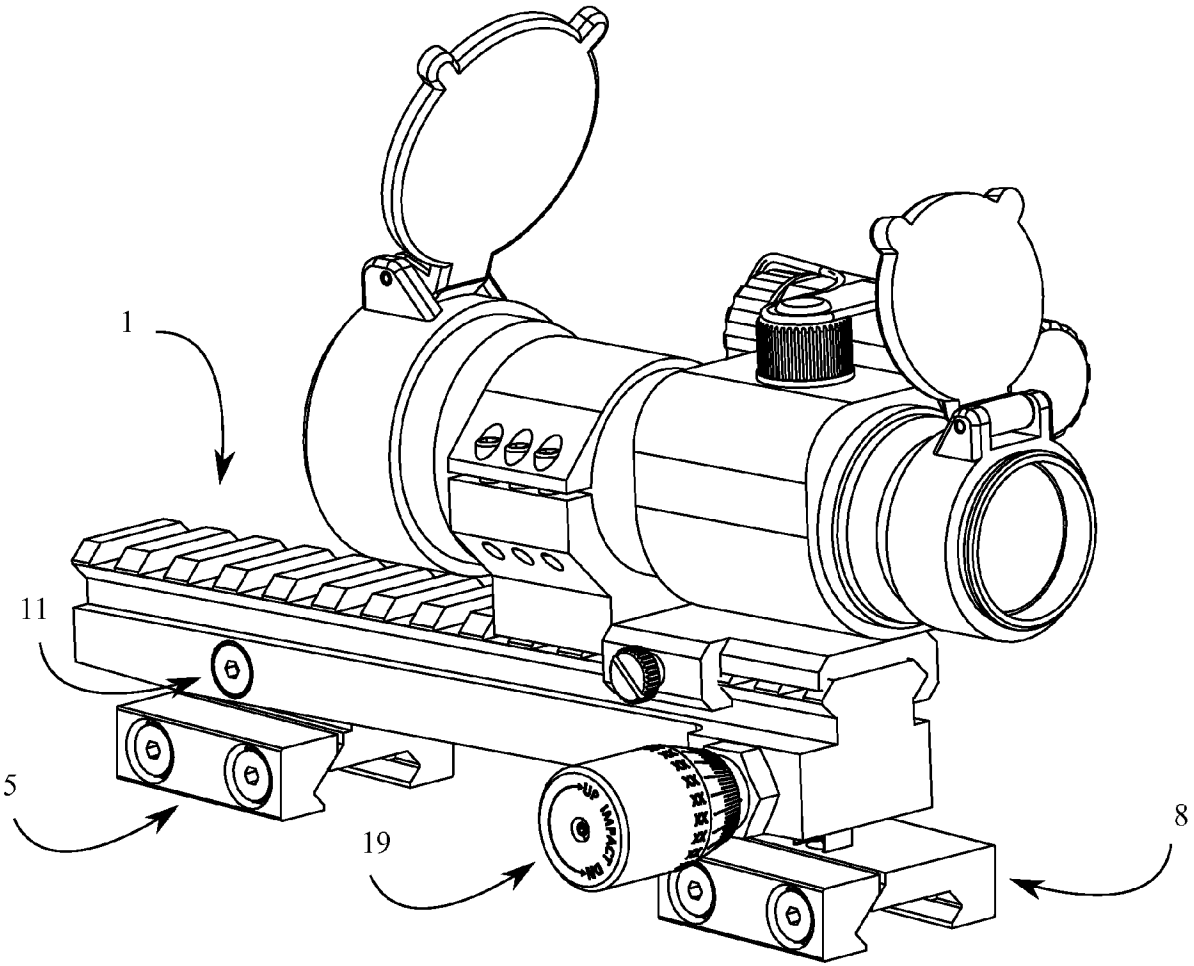
FIG. 4 is a perspective view of the vertically adjustable scope base with an attached optical sight as per the current embodiment of the present invention.
Figure 5:
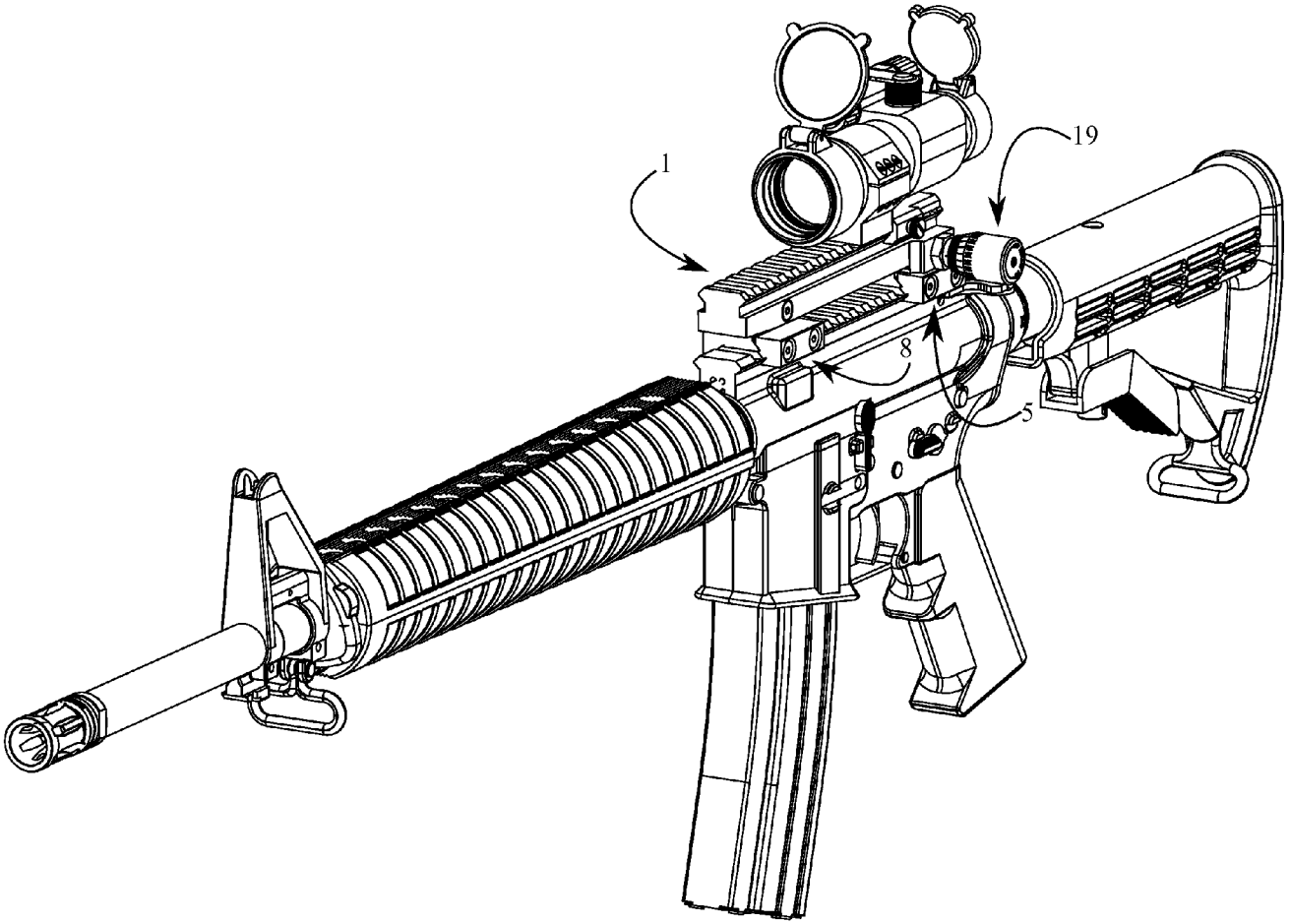
FIG. 5 is a perspective view of the vertically adjustable scope base attached to a weapon system with an attached optical sight as per the current embodiment of the present invention.

Referencing FIG. 3, the incline adjuster 19 is the precession mechanism that provides incremental inclination adjustment to the incline mechanism 12. The incline adjuster 19 is positioned adjacent to the incline mechanism 12. The incline adjuster 19 comprises an adjuster dial 20, an adjuster base 24, and an axle assembly 27. The adjuster dial 20 comprises an axle fastener 22, an axle emplacement 21, and a dial crown gear 23. The adjuster base 24 comprises an axle opening 25 and a base crown gear 26. The axle assembly 27 comprises an axle 28, a first axle crown gear 29, a second axle crown gear 30, first spring pin 31, a second spring pin 32, and a spring disc mechanism 33. The axle fastener 22, the axle emplacement 21, and the dial crown gear 23 are positioned collinear to each other. The axle fastener 22 is positioned adjacent to the axle emplacement 21. The axle emplacement 21 is positioned adjacent to the dial crown gear 23 which is found opposite to the position of the axle fastener 22. The base crown gear 26 and the axle opening 25 are positioned collinear to each other. The first axle crown gear 29, the second axle crown gear 30, and the spring disc mechanism 33 are positioned collinear to each other. The first axle crown gear 29 is positioned adjacent to the spring disc mechanism 33. The spring disc mechanism 33 is positioned adjacent to the second axle crown gear 30 which is found opposite to the first axle crown gear 29. The axle 28 traverses through the first axle crown gear 29, the spring disc mechanism 33, and the second axle crown gear 30. The first axle crown gear 29 and the second axle crown gear 30 are connected in place to the axle 28 by the first spring pin 31 and the second spring pin 32 respectively. The first spring pin 31 traverses into the first axle crown gear 29 and traverse through the axle 28. The second spring pin 32 traverse into the second axle crown gear 30 and traverses through the axle 28.

Referencing FIG. 3, the adjuster dial 20 and the adjuster base 24 are collinearly positioned to the axle assembly 27. The spring disc mechanism 33 and the second axle crown gear 30 traverse into the adjuster base 24. The axle 28 partially traverses through the adjuster base 24 by way of the axle opening 25. The adjuster base 24 sleeves the spring disc mechanism 33 and the second axle crown gear 30. The second axle crown gear 30 rotatably engages the base crown gear 26. The spring disc mechanism 33 securely grips the adjuster base 24. The first axle crown gear 29, the adjuster base 24, and the axle assembly 27 traverse into the adjuster dial 20. The adjuster dial 20 sleeves the first axle crown gear 29 and the adjuster base 24. The axle 28 is positioned centrally and connected normal to the axle emplacement 21 by the axle fastener 22. The first axle crown gear 29 is connectably engaged to the dial crown gear 23. Rotation of the adjuster dial 20 causes the spring disc mechanism 33 to partially compress causing the second axle crown gear 30 to partially disengage from the base crown gear 26. When the adjuster dial 20 stops rotating the spring disc mechanism 33 expands reengaging the second axle crown gear 30 with the base crown gear 26.

Referencing FIG. 2 and FIG. 3, the axle 28 portion that traverses through axle opening 25 traverses through the incline mechanism housing 13 and traverses into the axle mount 15. The axle 28 is rotatably attached to the adjuster bevel gear 14 by way of the axle mount 15. Rotation of the incline adjuster 19 rotates the adjuster bevel gear 14. The adjuster bevel gear 14 transfers the rotation to the extension rod bevel gear 16. The extension rod bevel gear 16 transfers the rotation to the threaded extension rod 18, which being engaged with the threaded sleeve 9 translates the rotation into vertical movement. Vertical movement of the threaded extension rod 18 as a result of its rotation within the threaded sleeve 9 translates into vertical movement of the incline mechanism 12. The incline mechanism 12 being affixed to the rail assembly 1, by way of the incline mechanism housing's 13 and the incline mechanism mount 3 produces vertical movement of the optics mount 2. The rail assembly 1 being pivotally connected to the front base 5, by of the pivot fastener 11, causes the optics mount 2 to pivot about the front base 5 producing an angle of incline.

The current embodiment of the present invention utilizes an incline adjuster 19 that allows users to quickly readjust the elevational incline of an optical sight to allow the reticle to coincide with the point of impact of the projectile. The present invention accomplishes this through the use of numerical inscriptions that are perimetrically positioned on the exterior of the adjuster dial 20. These markings coincide with a minute of angle measurements which signify an approximate one inch adjustment from point of impact at 100 yards. With rotation of the adjuster dial 20 the plurality of gear teeth of the second axle crown gear 30 that are engaged with the plurality of gear teeth of the base crown gear 26 temporarily disengage and reengage from each other. The peak of each gear tooth is equivalent to a predetermined change in the minute of angle measurement. Each instance of rotation causes an incremental adjustment to the elevational positioning of the optics mount 2. This incremental adjustment coincides with the inscribed numerical value on the adjuster dial 20. Furthermore, the present invention's utilization of this mechanism allows for rapid readjustments of an optical sight's positioning without necessitating the adjustment of the optical sight's reticle positioning. While moreover, the minute of angle inscriptions provide a user with a quick reference as to the desired range that the optical sight is calibrated for. Although the present invention has the inscriptions numerical value set for minute of angle measurements that utilize the imperial system, it would be an obvious difference to utilize minute of angle markings with corresponding gear engagements that relate to metric units or any other unit of measurements, calculated values, or derivations of calculated values that would be related to the vertical adjustment of a optical sight and specifically the readjustment of the reticle to coincide with a target at range.

In the current embodiment of the present invention, the optics mount 2 comprises a United States Military Standard 1913 rail system (MIL-STD-1913 rail), hereafter referred to as Picatinny rail, for attaching optical sights. Although the current embodiment utilizes a Picatinny rail system for the attaching the optical sights, the attachment mechanism for the present invention can utilize a plurality of mounting system that can include, but are not limited to, weaver rail system and North American Treaty Organization (NATO) Standardization Agreement 2324 rail systems (STANAG 2324 rail systems). Additionally, in the current embodiment of the present invention the front base 5 and the rear base 8 utilize a clamping mechanism for attaching the present invention to the Picatinny rail of a weapon system. Although, this is the existing method of attachment used by the current embodiment of the present invention it should be an obvious difference that the present invention can utilize a plurality of attachment methods that allow it to be connected to a weapons system that does not utilize a Picatinny rail system.

Furthermore, the current embodiment of the present invention utilizes a computerized numerically controlled (CNC) machining, wire-cut electrical discharge machining (Wire-EDM), and micro machining process to manufacture the more intricate components of the present invention. Components of the present invention that can be manufactured using, CNC machining, Wire EDM, and micro machine include, but are not limited to, the adjuster base 24 crown gear, the adjuster dial 20 crown gear, the first axle crown gear 29, the second axle crown gear 30, the adjuster bevel gear 14, the extension rod bevel gear 16, and the threaded extension rod 18. Although, the current embodiment utilizes the aforementioned machine process to manufacture components of the invention it should be understood as an obvious difference to substitute the current machining processes for a different process.

In addition to the specific interactions with optical sights, the present invention can be utilized with non-magnified and physical sights. The present invention provides an elevating rails system that is calibrated to increase with each partial rotation of the incline adjuster 19. This functionality can be utilized with a plurality of sighting devices that would benefit from proper sighting at greater distances. Furthermore, the present invention is not limited to firearms as the functionality can be utilized by any apparatus that benefits from precision adjustments for aligning a point of reference with the impact point of a parabolic shaped trajectory for a projectile. The apparatuses that the present invention can be utilized with include, but are not limited to paintball markers, air rifles, air-soft guns, compound bows, BB-guns, and crossbows.

Although the invention has been explained in relation to its preferred embodiment, it is to be understood that many other possible modifications and variations can be made without departing from the spirit and scope of the invention as hereinafter claimed.

What is claimed is:

1. A vertically adjustable scope base comprises,
- a rail assembly;
- a front base;
- a rear base;
- an incline mechanism;
- an incline adjuster;
- a pivot fastener;
- the rail assembly comprises an optics mount, an incline mechanism mount, and a pivot mechanism mount;
- the front base comprises a pivot mechanism and a front base attachment mechanism;
- the rear base comprises a threaded sleeve and a rear base attachment mechanism;
- the incline mechanism comprises an incline mechanism housing, an adjuster bevel gear, an extension rod bevel gear, and a threaded extension rod;
- the adjuster bevel gear comprises an axle mount; and
- the extension rod bevel gear comprises an extension rod mount.

2. The vertically adjustable scope base mount as claimed in claim 1 comprises,
- the front base being positioned coplanar to the rear base;
- the rail assembly being positioned parallel to the front base and rear base;
- the incline mechanism being positioned adjacent to the rail assembly and the rear base; and
- the incline adjuster being positioned adjacent to the incline mechanism.

3. The vertically adjustable scope base mount as claimed in claim 1 comprises,
- the optics mount being positioned along the rail assembly;
- the incline mechanism mount being positioned on the rail assembly opposite the optics mount;

the pivot mechanism mount being positioned on the rail assembly opposite the optics mount; and the incline mechanism mount and the pivot mechanism being positioned opposite along the rail assembly.

4. The vertically adjustable scope base mount as claimed in claim 1 comprises, the pivot mechanism being positioned above the front base attachment mechanism; and the threaded sleeve being positioned above the rear base attachment mechanism.

5. The vertically adjustable scope base mount as claimed in claim 1 comprises, the adjuster bevel gear, the extension rod bevel gear, and the threaded extension rod being positioned within the mechanism housing; and the extension rod bevel gear being perpendicularly engaged to the adjuster bevel gear.

6. The vertically adjustable scope base mount as claimed in claim 1 comprises, the axle mount being positioned concentrically to the adjuster bevel gear;

the extension rod mount being positioned concentrically to the extension rod bevel gear; and the threaded extension rod being rotatably connected to the extension rod bevel gear by way of the extension rod mount.

7. The vertically adjustable scope base mount as claimed in claim 1 comprises, the pivot mechanism being pivotally connected to the pivot mechanism mount by the pivot fastener;

the threaded extension rod and the extension rod bevel gear being collinearly positioned with the threaded sleeve;

the threaded extension rod being engaged with the threaded sleeve; and the incline mechanism housing being attached to the incline mechanism mount.

8. The vertically adjustable scope base mount as claimed in claim 1 comprises, the incline adjuster comprises an adjuster dial, an adjuster base, and an axle assembly;

the adjuster dial and the adjuster base being collinearly positioned to the axle assembly;

the axle assembly traverses into the adjuster base;

the adjuster base and the axle assembly traverse into the adjuster dial;

the adjuster base being sleeved by the adjuster dial;

the adjuster dial comprises an axle emplacement, an axle fastener, and a dial crown gear;

the adjuster base comprises an axle opening, and a base crown gear;

the axle assembly comprises an axle, a first axle crown gear, a second axle crown gear, a first spring pin, a second spring pin, and a spring disc mechanism.

9. The vertically adjustable scope base mount as claimed in claim 8 comprises, the axle fastener, the axle emplacement, and the dial crown gear being positioned collinearly to one another;

the axle fastener being positioned adjacent to the axle emplacement;

the axle emplacement being positioned adjacent to the dial crown gear, opposite to the axle fastener;

the base crown gear and the axle opening being positioned collinearly to each other;

the first axle crown gear, spring disc assembly, and the second axle crown gear being positioned collinearly to each other;

the first axle crown gear being positioned adjacent to the spring disc mechanism;

the second axle crown gear being positioned adjacent to the spring disc mechanism, opposite the first axle crown gear;

the axle traverses through the first axle crown gear, the spring disc mechanism, and the second axle crown gear;

the first axle crown gear being attached to the axle by the first spring pin; and the second axle crown gear being attached to the axle by the second spring pin.

10. The vertically adjustable scope base mount as claimed in claim 8 comprises, the axle traverses through the base crown gear and the axle opening;

the first axle crown gear, the spring disc mechanism, and the second axle crown gear traverse into the adjuster base;

the first axle crown gear, the spring disc mechanism, and the second axle crown gear being sleeved by the adjuster base;

the second axle crown gear being rotatably engaged to the base crown gear;

the axle traverse through the dial crown gear;

the axle traverse into the axle emplacement;

the axle being centrally positioned and connected normal to the axle emplacement by the axle fastener; and the first axle crown gear being connectably engaged to the dial crown gear.

11. The vertically adjustable scope base mount as claimed in claim 8 comprises, the axle traverses into the adjuster bevel gear; and the axle being rotatably attached to the axle mount.

12. A vertically adjustable scope base comprises, a rail assembly;

a front base;

a rear base;

an incline mechanism;

an incline adjuster;

a pivot fastener;

the rail assembly comprises an optics mount, an incline mechanism mount, and a pivot mechanism mount;

the front base comprises a pivot mechanism and a front base attachment mechanism;

the rear base comprises a threaded sleeve and a rear base attachment mechanism;

the incline mechanism comprises an incline mechanism housing, an adjuster bevel gear, an extension rod bevel gear, and a threaded extension rod;

the incline adjuster comprises an adjuster dial, an adjuster base, and an axle assembly;

the adjuster bevel gear comprises an axle mount;

the extension rod bevel gear comprises an extension rod mount;

the adjuster dial and the adjuster base being collinearly positioned to the axle assembly;

the axle assembly traverses into the adjuster base;

the adjuster base and the axle assembly traverse into the adjuster dial;

the adjuster base being sleeved by the adjuster dial;

the adjuster dial comprises an axle emplacement, an axle fastener, and a dial crown gear;

the adjuster base comprises an axle opening, and a base crown gear; and;

the axle assembly comprises an axle, a first axle crown gear, a second axle, crown gear, a first spring pin, a second spring pin, and a spring disc mechanism.

13. The vertically adjustable scope base mount as claimed in claim 12 comprises, the front base being positioned coplanar to the rear base;

the rail assembly being positioned parallel to the front base and rear base;

the incline mechanism being positioned adjacent to the rail assembly and the rear base; and the incline adjuster being positioned adjacent to the incline mechanism.

14. The vertically adjustable scope base mount as claimed in claim 12 comprises, the optics mount being positioned along the rail assembly;

the incline mechanism mount being positioned on the rail assembly opposite the optics mount;

the pivot mechanism mount being positioned on the rail assembly opposite the optics mount;

the incline mechanism mount and the pivot mechanism being positioned opposite along the rail assembly;

the pivot mechanism being positioned above the front base attachment mechanism;

the threaded sleeve being positioned above the rear base attachment mechanism;

the adjuster bevel gear, the extension rod bevel gear, and the threaded extension rod being positioned within the mechanism housing; and the extension rod bevel gear being perpendicularly engaged to the adjuster bevel gear.

15. The vertically adjustable scope base mount as claimed in claim 12 comprises, the axle mount being positioned concentrically to the adjuster bevel gear;

the extension rod mount being positioned concentrically to the extension rod bevel gear;

the threaded extension rod being rotatably connected to the extension rod bevel gear by way of the extension rod mount;

the pivot mechanism being pivotally connected to the pivot mechanism mount by the pivot fastener;

the threaded extension rod and the extension rod bevel gear being collinearly positioned with the threaded sleeve;

the threaded extension rod being engaged with the threaded sleeve; and the incline mechanism housing being attached to the incline mechanism mount.

16. The vertically adjustable scope base mount as claimed in claim 12 comprises, the axle fastener, the axle emplacement, and the dial crown gear being positioned collinearly to one another;

the axle fastener being positioned adjacent to the axle emplacement;

the axle emplacement being positioned adjacent to the dial crown gear, opposite to the axle fastener;

the base crown gear and the axle opening being positioned collinearly to each other;

the first axle crown gear, spring disc assembly, and the second axle crown gear being positioned collinearly to each other;

the first axle crown gear being positioned adjacent to the spring disc mechanism;

the second axle crown gear being positioned adjacent to the spring disc mechanism, opposite the first axle crown gear;

the axle traverses through the first axle crown gear, the spring disc mechanism, and the second axle crown gear;

the first axle crown gear being attached to the axle by the first spring pin;

the second axle crown gear being attached to the axle by the second spring pin;

the axle traverses through the base crown gear and the axle opening;

the first axle crown gear, the spring disc mechanism, and the second axle crown gear traverse into the adjuster base;

the first axle crown gear, the spring disc mechanism, and the second axle crown gear being sleeved by the adjuster base;

the second axle crown gear being rotatably engaged to the base crown gear;

the axle traverse through the dial crown gear;

the axle traverse into the axle emplacement;

the axle being centrally positioned and connected normal to the axle emplacement by the axle fastener;

the first axle crown gear being connectably engaged to the dial crown gear;

the axle traverses into the adjuster bevel gear; and the axle being rotatably attached to the axle mount.

17. A vertically adjustable scope base comprises, a rail assembly;

a front base;

a rear base;

an incline mechanism;

an incline adjuster;

a pivot fastener;

the rail assembly comprises an optics mount, an incline mechanism mount, and a pivot mechanism mount;

the front base comprises a pivot mechanism and a front base attachment mechanism;

the rear base comprises a threaded sleeve and a rear base attachment mechanism;

the incline mechanism comprises an incline mechanism housing, an adjuster bevel gear, an extension rod bevel gear, and a threaded extension rod;

the incline adjuster comprises an adjuster dial, an adjuster base, and an axle assembly;

the adjuster bevel gear comprises an axle mount;

the extension rod bevel gear comprises an extension rod mount;

the adjuster dial and the adjuster base being collinearly positioned to the axle assembly;

the axle assembly traverses into the adjuster base;

the adjuster base and the axle assembly traverse into the adjuster dial;

the adjuster base being sleeved by the adjuster dial;

the adjuster dial comprises an axle emplacement, an axle fastener, and a dial crown gear;

the adjuster base comprises an axle opening, and a base crown gear; and the axle assembly comprises an axle, a first axle crown gear, a second axle crown gear, a first spring pin, a second spring pin, and a spring disc mechanism;

the front base being positioned coplanar to the rear base;

the rail assembly being positioned parallel to the front base and rear base;

the incline mechanism being positioned adjacent to the rail assembly and the rear base; and the incline adjuster being positioned adjacent to the incline mechanism.

18. The vertically adjustable scope base mount as claimed in claim 17 comprises, the optics mount being positioned along the rail assembly;

the incline mechanism mount being positioned on the rail assembly opposite the optics mount;

the pivot mechanism mount being positioned on the rail assembly opposite the optics mount;

the incline mechanism mount and the pivot mechanism being positioned opposite along the rail assembly;

the pivot mechanism being positioned above the front base attachment mechanism;

the threaded sleeve being positioned above the rear base attachment mechanism;

the adjuster bevel gear, the extension rod bevel gear, and the threaded extension rod being positioned within the mechanism housing;

the extension rod bevel gear being perpendicularly engaged to the adjuster bevel gear;

the axle mount being positioned concentrically to the adjuster bevel gear;

the extension rod mount being positioned concentrically to the extension rod bevel gear;

the threaded extension rod being rotatably connected to the extension rod bevel gear by way of the extension rod mount;

the pivot mechanism being pivotally connected to the pivot mechanism mount by the pivot fastener;

the threaded extension rod and the extension rod bevel gear being collinearly positioned with the threaded sleeve;

the threaded extension rod being engaged with the threaded sleeve; and the incline mechanism housing being attached to the incline mechanism mount.

19. The vertically adjustable scope base mount as claimed in claim 17 comprises, the axle fastener, the axle emplacement, and the dial crown gear being positioned collinearly to one another;

the axle fastener being positioned adjacent to the axle emplacement;

the axle emplacement being positioned adjacent to the dial crown gear, opposite to the axle fastener;

the base crown gear and the axle opening being positioned collinearly to each other;

the first axle crown gear, spring disc assembly, and the second axle crown gear being positioned collinearly to each other;

the first axle crown gear being positioned adjacent to the spring disc mechanism;

the second axle crown gear being positioned adjacent to the spring disc mechanism, opposite the first axle crown gear;

the axle traverses through the first axle crown gear, the spring disc mechanism, and the second axle crown gear;

the first axle crown gear being attached to the axle by the first spring pin;

the second axle crown gear being attached to the axle by the second spring pin;

the axle traverses through the base crown gear and the axle opening;

the first axle crown gear, the spring disc mechanism, and the second axle crown gear traverse into the adjuster base;

the first axle crown gear, the spring disc mechanism, and the second axle crown gear being sleeved by the adjuster base;

the second axle crown gear being rotatably engaged to the base crown gear;

the axle traverse through the dial crown gear;

the axle traverse into the axle emplacement;

the axle being centrally positioned and connected normal to the axle emplacement by the axle fastener;

the first axle crown gear being connectably engaged to the dial crown the axle traverses into the adjuster bevel gear; and the axle being rotatably attached to the axle mount.

* * * * *